United States Patent [19]

Vyavaharkar et al.

[11] Patent Number: 4,835,984

[45] Date of Patent: Jun. 6, 1989

[54] EVAPORATOR CONDENSATE PAN WITH INTEGRAL TRAP

[75] Inventors: Dilip Y. Vyavaharkar, Liverpool; Rudy C. Bussjager, Chittenango, both of N.Y.

[73] Assignee: Carrier Corporation, Syracuse, N.Y.

[21] Appl. No.: 251,738

[22] Filed: Oct. 3, 1988

[51] Int. Cl.[4] ..... F25D 21/14

[52] U.S. Cl. ..... 62/285; 62/291

[58] Field of Search ..... 62/285, 291, 272

[56] References Cited

U.S. PATENT DOCUMENTS

| | | | |
|---|---|---|---|
| 2,725,271 | 11/1955 | Cunningham | 62/291 X |
| 3,224,216 | 12/1965 | Crouch | 62/291 X |
| 3,596,475 | 8/1971 | Berger | 62/285 |
| 3,599,442 | 8/1971 | Hanson | 62/285 X |
| 4,693,091 | 9/1987 | O'Mara et al. | 62/272 |

*Primary Examiner*—Lloyd L. King

*Attorney, Agent, or Firm*—Dana F. Bigelow

[57] ABSTRACT

An evaporator condensate pan has a condensate trap incorporated therein to thereby eliminate the need for the installation of the separate component. A well structure is provided in the bottom wall of the condensate pan and an additional depending wall structure is provided such that the depending wall, together with a side wall of a well, define a passage way which retains a column of water for preventing the flow air into the condensate pan while allowing the flow of condensate out of the pan. Provision is made for such a combination discharge drain and trap in either a side or bottom wall of the condensate pan.

6 Claims, 1 Drawing Sheet

EVAPORATOR CONDENSATE PAN WITH INTEGRAL TRAP

BACKGROUND OF THE INVENTION

This invention relates generally to air conditioning equipment and, more particularly, to an evaporator condensate pan and associated trap structure.

In the normal operation of an air conditioning system, the evaporator or fan coil tends to be at temperatures below the dew point of the surrounding air. The resulting condensation is collected in a pan located under the coil, with the pan being drained off to an appropriate cite such as a sewer drain or to the ground outside.

Because of a low pressure condition that is created by the operation of the fan inside the unit, it has become conventional practice to provide a P-trap to prevent the inward flow of air through the drainage pipe, which flow of air would otherwise tend to prevent the flow of condensate from the condensate pan.

Heretofore, the P-trap was not part of the air conditioning unit, but was rather a component that was installed outside of the unit by the serviceman in the field. Although it is a relatively simple task, it does involve additional time and materials. Further, there are occasions when the serviceman forgets to install the trap, or installs it improperly, thereby resulting in improper operation of the system.

It is therefore an object of the present invention to provide an improved trap structure for a condensate pan.

Another object of the present invention is the provision for a condensate pan trap that does not require installation in the field.

Yet another object of the present invention is the provision for eliminating the problems associated with improper installation of, or failure to install, a trap in an air conditioning system.

Still another object of the present invention is the provision for a condensate trap which is easy to manufacture and economical and effective in use.

These objects and other features and advantages become more readily apparent upon reference to the following description when taken in conjunction with the appended drawings.

SUMMARY OF THE INVENTION

Briefly, in accordance with one aspect of the invention, a trap is formed integrally with the condensate pan structure. This is accomplished by providing, near the condensate pan drainage opening, a lowered well structure having side walls and a suspended wall extending downwardly into the well to define, in cooperation with a portion of the well side walls, a trap structure for containing a column of condensate which permits the flow of condensate therethrough as it passes to the drainage opening but prevents the flow of air from the drainage opening to the condensate pan.

By another aspect of the invention, the drainage opening is formed in a side wall of the condensate pan and at least one well side wall is formed by the side wall of the condensate pan itself.

By yet another aspect of the invention, the drainage opening is formed in the condensate pan bottom wall, and that portion of said well side wall which defines the trap is separate from the side wall of said condensate pan.

In the drawings as hereinafter described, a preferred embodiment is depicted; however, various other modifications and alternate constructions can be made thereto without departing from the true spirit and scope of the invention.

BRIEF DESCRIPTION OF THE PREFERRED EMBODIMENT

Figure 1:
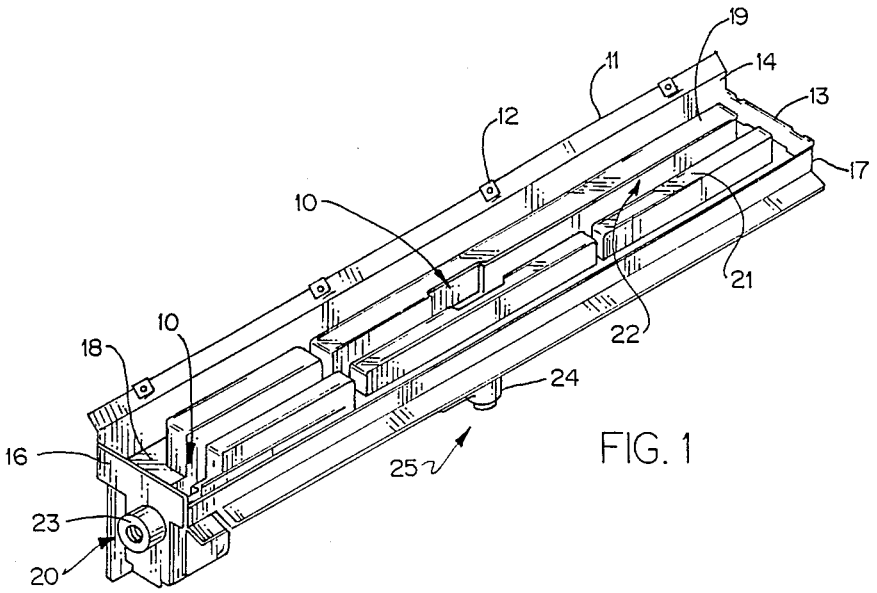
FIG. 1 is a perspective view of a condensate pan in accordance with the present invention.
Figure 2:
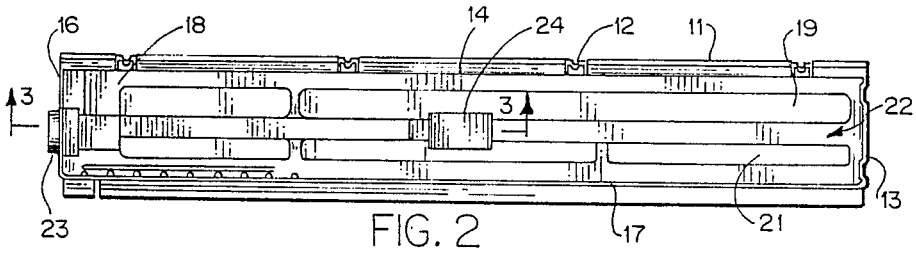
FIG. 2 is a top view thereof.

Referring now to FIG. 1, the invention is shown generally at 10 as applied to a condensate pan 11 which is designed to be mounted below an evaporator coil (not shown) by a plurality of mounting tabs 12. The purpose of the condensate pan 11 is to collect the condensate that forms on the evaporator coil and to provide for the disposal thereof by way of drainage to an appropriate disposal site such as an open sewer drain or the like.

The condensate pan 11, which is preferably comprised of a rigid, non-metallic material such as plastic or the like, is formed in a box-like structure having side walls 13, 14, 16, and 17 and a bottom wall 18. Longitudinally extending risers 19 and 21 extend upwardly from the bottom wall 18 to define a central space 22 therebetween. The purpose of the risers 19 and 21 is to provide structural rigidity to the condensate pan 11 and to act as a pedestal to hold the coil up from direct contact with the condensate.

Fluidly communicating with the central space 22 is a side discharge structure 23 with its drain opening 20 and a bottom discharge structure 24 with its drain opening 25, one of which is connected to a tube for draining away the condensate from the condensate pan 11, and the other of which is made ineffective by the insertion of a plug therein. Thus, the two discharge drain openings 20 and 25 function in essentially the same manner, with only one of them being used, depending on the particular installation requirements.

Figure 3:
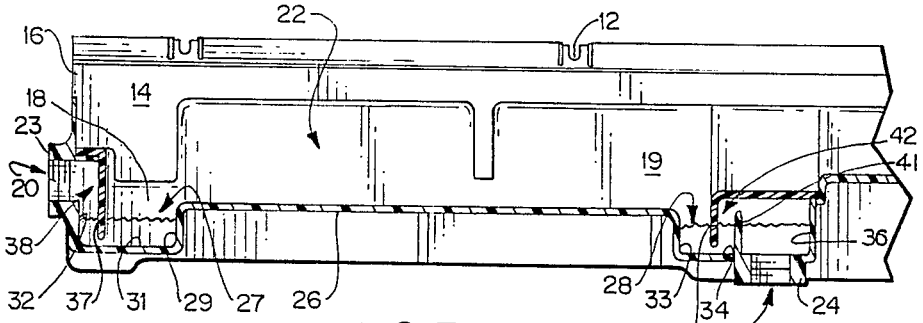
FIG. 3 is a longitudinal, sectional view thereof as seen along line 33 of FIG. 2.

Defining the lower boundary of the central space 22 is a lower wall 26 which, as will be seen from FIG. 3, is lower than the bottom wall 18 on either side thereof. At the ends of the lower wall 26 are the respective side discharge well 27 and bottom discharge well 28 leading to the respective side discharge drain opening 20 and bottom discharge opening 25. The side discharge well 27 partially defining by side wall 29, bottom wall 31, and side wall 32, and the bottom discharge well 28 is partially defined by side wall 33, bottom wall 34, and side wall 36.

In order for the discharge wells 27 and 28 to serve as traps, it is necessary to provide additional structure such that a column of water is maintained in a passage such that condensate is permitted to flow through the passage but air is not. Thus, associated with the side discharge well 27 is a depending wall 37 which extends downwardly from the side discharge structure 23 toward, but not extending to, the well bottom wall 31 such that a passage 38 is defined between the side wall 32 and the depending wall 37. Thus, as long as there is any water in the condensate pan 11, since the side discharge well 27 is at the lowest point, there will always be condensate in that well and in the passage 38. As the level of the condensate builds up to the point where it reaches the opening 20, the condensate will tend to flow out of the condensate pan 11. But so long as there is condensate in the passage 38, the flow of air into the opening 20 will be prevented.

In a similar manner, the bottom discharge well 28 has associated therewith, a depending wall 39 which is attached to and extends downwardly from the bottom drain structure 24 as shown in FIG. 3. However, in this case, since the opening 25 is in the bottom of the discharge drain structure 24, it is necessary to provide an upstanding wall 41 between the depending wall 38 and the opening 25. In this way, the depending wall 39 and the upstanding wall 41 define a passage 42 which functions in the same way as the passage 38 in the side discharge wall 27.

While the present invention has been disclosed with particular reference to a preferred embodiment, the concepts of this invention are readily adaptable to other embodiments, and those skilled in the art may vary the structure thereof without departing from the essential spirit of the present invention.

What is claimed is:

1. An air conditioning system of the type having an evaporator coil, a fan blowing air thereover, a condensate pan with bottom and side walls for collecting condensate forming on the coil and a drainage opening formed in the condensate pan, an improved trap structure associated with said drainage opening and forming a part of said condensate pan comprising:

a bottom wall and side walls formed integrally with said condensate pan bottom wall, said trap structure bottom wall being at a lower elevation than the remaining portion of said condensate pan bottom wall and at least a portion of said side wall rising upwardly to define a vertical barrier over which the condensate must flow in order enter the drainage opening; and a suspended wall structure attached to the condensate pan and extending downwardly towards, but not to, said trap lower wall, wherein said side wall portion and said suspended wall structure cooperate to form a conduit for conducting the flow of condensate from the condensate pan to the discharge opening while maintaining a vertical column of condensate therein to prevent the flow of air from the discharge opening to the condensate pan.

2. The trap structure as set forth in claim 1 wherein said discharge opening is formed in the condensate pan side wall and further wherein said trap side wall portion is formed, at least in part, by a portion of said condensate pan side wall.

3. The trap structure as set forth in claim 1 wherein said drainage opening is formed in said condensate pan bottom wall and further wherein said trap side wall portion is separate from said condensate pan side wall.

4. An improved condensate pan for use with an evaporator coil and associated fan comprising:

bottom and side walls defining a container for collecting condensate from the coil above;

a discharge opening in one of said walls for conducting the flow of condensate therefrom;

a well structure formed integrally with said container bottom wall, adjacent said discharge opening, said well structure having a bottom and side walls with said well bottom wall being lower in elevation than the remaining portion of said container bottom wall, and portions of said well side walls extending upwardly to define a portion of a trap structure; and a suspended wall attached to said container and extending downwardly toward, but spaced from, said well bottom wall, said suspended wall defining the remaining portion of said trap structure for containing a column of condensate to prevent the flow of air through said discharge opening into said container.

5. The condensate pan as set forth in claim 4 wherein said discharge opening is formed in the side wall of said condensate pan, and further wherein at least a portion of said well side wall portions is formed by a portion of said condensate pan side walls.

6. A condensate pan as set forth in claim 4 wherein said discharge opening is formed in the condensate pan bottom wall, and further wherein said well side wall portions are separate from said condensate pan side walls.

* * * * *